United States Patent [19]

Nishina et al.

[11] 4,211,835

[45] Jul. 8, 1980

[54] LIGHT-SENSITIVE SILVER HALIDE PHOTOGRAPHIC MATERIAL AND METHOD OF PROCESSING THE SAME

[75] Inventors: Yoshio Nishina; Syunji Matsuo; Toshio Nagatani; Kazuo Takahashi; Takeshi Habu, all of Hino, Japan

[73] Assignee: Konishiroku Photo Industry Co., Ltd., Tokyo, Japan

[21] Appl. No.: 869,609

[22] Filed: Jan. 16, 1978

[30] Foreign Application Priority Data

Jan. 27, 1977 [JP] Japan ..... 52-7274

[51] Int. Cl.[2] ..... G03C 5/30; G03C 1/06

[52] U.S. Cl. ..... 430/403; 430/436; 430/442; 430/446; 430/949; 430/613

[58] Field of Search ..... 96/66, 107, 109, 95

[56] References Cited

U.S. PATENT DOCUMENTS

| | | | |
|---|---|---|---|
| 3,071,465 | 1/1963 | Dersch et al. | 96/109 |
| 3,420,664 | 1/1969 | Dersch et al. | 96/109 |
| 3,592,656 | 7/1971 | Brooks | 96/109 |
| 3,597,213 | 8/1971 | Dersch et al. | 96/109 |
| 3,847,618 | 11/1974 | Hofman | 96/66.3 |
| 3,909,268 | 9/1975 | Baldassari | 96/109 |
| 3,942,985 | 3/1976 | Newman | 96/66.3 |
| 3,955,983 | 5/1976 | Nakajima | 96/66.3 |

FOREIGN PATENT DOCUMENTS

| | | | |
|---|---|---|---|
| 2634666 | 2/1977 | Fed. Rep. of Germany | 96/95 |

OTHER PUBLICATIONS

Making & Coating Emulsions by Zelikman, 1965, p. 13.

*Primary Examiner*—Mary F. Kelley
*Attorney, Agent, or Firm*—Frishauf, Holtz, Goodman & Woodward

[57] ABSTRACT

A method of processing light-sensitive silver halide photographic material to be treated with a developing solution containing no hydroquinones developing agent, which material comprises a support, a silver halide emulsion layer coated thereon containing silver halide grains having an average grain size of 0.1 to 0.8$\mu$, at least 75% of said grains being within a range of 0.6 to 1.4 times the said average grain size, and a tetrazolium specified compound.

9 Claims, No Drawings

LIGHT-SENSITIVE SILVER HALIDE PHOTOGRAPHIC MATERIAL AND METHOD OF PROCESSING THE SAME

The present invention relates to a novel light-sensitive silver halide photographic material and the processing method therefor. Particularly, it relates to a novel lith type light-sensitive silver halide photographic material for obtaining a photographic image with an especially high contrast, high sharpness and high resolving power, and to the processing method therefor.

More particularly, it relates to a novel light-sensitive silver halide photographic material which is applicable advantageously to a light-sensitive silver halide photographic material with a high contrast suitable for forming a dot- or line-image on a lith (printing) light-sensitive silver halide material or a copying silver halide light-sensitive material, as well as to the processing method therefor.

It has been known to form a photographic image with an extremely high contrast by using some kind of a light-sensitive silver halide photographic material.

It has been known, for example, to obtain a high contrast image, e.g. a line- or dot-image by treating, with an alkaline hydroquinone developing solution containing sulfite ions in a very low concentration, a light-sensitive material which comprises a silver chlorobromide emulsion containing silver chloride in a high content (at least more than 50 mole %) the grains of which emulsion being minute (average grain size; ca. 0.2$\mu$), uniform in size and shape, and the grain size distribution thereof being narrow. The above-mentioned kind of light-sensitive silver halide material is known as the lith type light-sensitive material.

In printing, there is usually required such a process to convert a continuous gradation original image to a dot image; that is a process to convert the densities of the continuous gradation to a predetermined numbered assembly of dots respectively having areas of the same densities but proportional in size to the densities of the continuous gradation. In order to carry out this, the lith type light-sensitive material is subjected to development, after photographing the original image through a cross- or contact-screen, to form the dot image on the light-sensitive material.

For this purpose there has been employed a light-sensitive silver halide photographic material containing a silver halide emulsion, the grains of which being minute and being uniform in size and shape. Even when this kind of a light-sensitive silver halide photographic material is employed, the intermediate density region (undesirable continuous gradation parts) is reproduced, beside the maximum density region and the minimum one (fog), when the material is processed with a standard black-and-white developing solution. The intermediate density region becomes the so-called fringe, undesirable for producing a printing plate and makes the dot quality worse.

There has heretofore been employed the lith type light-sensitive material also for the reproduction of a line image. For the same reason, however, there have been obtained images having at best the $\gamma$-value of 5–6 of the characteristic curve, which value is lower than 7–9 required for forming the desirable line-image, if the standard black-and-white developing solution is employed. In order to avoid this, there has been employed, as mentioned above, a specific developing solution called "an infectious developing solution."

The infectious or lith type developing solution is referred to as a developing solution in which hydroquinone is substantially the sole developing agent and the concentration of sulfite ion is low, as described in detail in J. A. C. Yule, J. Franklin Inst., 239, 221 (1945).

As is presumed from the composition, lith type developing solution is poor in storability and subject to autoxidation. It is therefore an unavoidable tendency that the control system of a trader concerned with photomechanical processing for obtaining a halftone negative/positive of high quality becomes complicated.

As it is extremely advantageous to improve the storability of lith type developing solution, every effort has been made therefor. However there has been known no method capable of obtaining a dot image with a good dot quality, by using a developing solution which can compare in storability with such a developing solution for continuous gradation as Metol/hydroquinone or phenidone/hydroquinone developing solution, e.g., Sakura dol type 311, type 411, type 431, etc. (Sakuradole is a registered trademark.).

It is, therefore, the primary object of the invention to provide a novel light-sensitive silver halide photographic material and the processing method thereof to obtain a high contrast silver image.

It is another object of the invention to provide a novel lith type light-sensitive silver halide material containing a tetrazolium compound suitable for obtaining a dot- or line-image.

It is still another object of the invention to provide a novel processing method of the above-mentioned lith type light-sensitive silver halide material to obtain a high contrast black-and-white silver image, especially a dot- or line-image.

Further object of this invention is to provide a novel light-sensitive silver halide photographic material which is treated with a developing solution of good storability, namely, a developing solution containing no hydroquinone developing agent.

Still further object of this invention is to provide a novel processing method of a light-sensitive silver halide photographic material using a developing solution of good storability, namely, a developing solution containing no hydroquinone developing agent.

The above-mentioned objects of this invention and other objects mentioned hereinafter can be attained by using a light-sensitive silver halide photographic material in which a silver halide emulsion layer is coated on a support and which is treated with a developing solution containing no hydroquinone developing agent, which contains silver halide grains having an average grain size of 0.05 to 1.5$\mu$, at least 75% of which grains being within a range of 0.6 to 1.4 times the average grain size and a tetrazolium compound; and by processing said silver halide light-sensitive photographic material, after imagewise exposure, with a developing solution containing no hydroquinone developing agent.

The inventors have found, that the object can be attained by processing a lith type light-sensitive silver halide photographic material containing, silver halide grains having a narrow grain size distribution, and a tetrazolium compound, after imagewise exposure, with a developing solution containing no hydroquinone developing agent.

In accordance with the invention, there can be formed a superior line- or dot-image, without employing the infectious development, by processing a light-sensitive silver halide photographic material having coated on a support at least one hydrophilic colloidal layer which comprises light-sensitive silver halide grains having an average grain size of 0.05–1.5μ and at least 75% of the total grains being within a range of 0.6–1.4 times the average grain size, and a tetrazolium compound, after the imagewise exposure, with a developing solution containing no hydroquinone developing agent.

According to a preferred embodiment of the invention, there is obtained a high contrast silver image with superior reproducibility of the line image by processing a light-sensitive silver halide photographic material containing silver halide grains having the above-mentioned grain size and the distribution thereof (hereinafter referred to as the silver halide of the invention) and a diffusible tetrazolium compound, after imagewise exposure, with a developing solution containing no hydroquinone developing agent.

According to another preferred embodiment of the invention, there is obtained a dot-image (halftone image) with a superior dot quality by developing a light-sensitive silver halide photographic material containing the silver halide of the invention and a non-diffusible tetrazolium compound, after imagewise exposure, through a contact screen, with a developing solution containing no hydroquinone developing agent and containing one or more developing agent, e.g., phenidone-Metol developing solution, Metol developing solution, phenidone-ascorbic acid developing solution, p-phenylenediamine-Metol developing solution, etc.

The developing solution used in the processing method to which this invention relates, is a developing solution containing no hydroquinones as a developing agent. As will be mentioned hereinafter, the developing solution which is used in the invention (hereinafter referred to as the developing solution of the invention) is a developing solution containing at least one developing agent such as Metol, phenidone, glycine, etc. excluding hydroquinones developing agent.

In the invention, there may be added, for other purposes, a hydroquinone developing agent in extremely small amounts which do not impair the effect of the invention to the developing solution of the invention.

It can not be expected from heretofore known techniques that the high contrast line- or dot-image could be obtained without employing the infectious developing solution containing hydroquinones as a developing agent.

The term "non-diffusible tetrazolium compound" in the invention means a compound which does not dissolve from the light-sensitive material to the developing solution during the development. In other words, the compound does not dissolve in a concentration of several %, preferably not more than 2%, when a gelatin layer containing the compound is dipped for 10 minutes in an aqueous solution at 20°–40° C. having the same ion strength and pH-value as those of the developing solution.

The representative tetrazolium compounds employed in the invention include the following compounds represented by the general formulae:

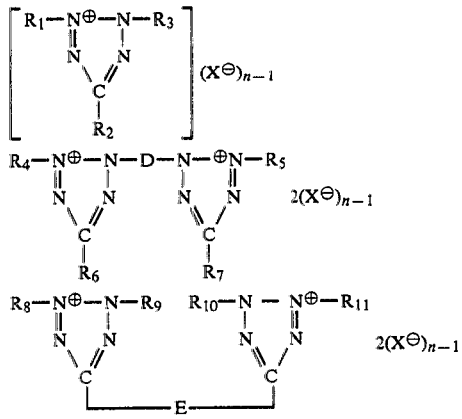

(I)

(II)

(III)

In the above formulae, $R_1$, $R_3$, $R_4$, $R_5$, $R_8$, $R_9$, $R_{10}$ and $R_{11}$ each represent a group selected from an alkyl group (e.g., methyl, ethyl, propyl, dodecyl, etc.), an alkenyl group such as an allyl group, an aryl group such as a phenyl group (e.g., phenyl, tolyl, chlorophenyl, bromophenyl, iodophenyl, hydroxyphenyl, carboxyphenyl, aminophenyl, nitrophenyl or mercaptophenyl, etc.), a naphthyl group (e.g., α-naphthyl, β-naphthyl, hydroxynaphthyl, carboxynaphthyl or aminonaphthyl, etc.) and a heterocyclic group (e.g., thiazolyl group, benzothiazolyl group, oxazolyl group, pyrimidinyl group or pyridyl group, etc.), and each group may be a group capable of forming a metal chelate or a complex; $R_2$, $R_6$ and $R_7$ each represent an alkenyl group such as allyl, a phenyl group and a naphthyl group, a heterocyclic group, an alkyl group (e.g., methyl, ethyl, propyl, butyl, mercaptomethyl or mercaptoethyl, etc.), a hydroxyl group, a carboxyl group or the salt thereof, an alkoxycarbonyl group (e.g., methoxycarbonyl, ethoxycarbonyl, etc.), an amino group (e.g. amino, ethylamino or anilino, etc.), a mercapto group such as —SR'[R' is a hydrogen, an alkyl group (e.g., methyl, ethyl, etc.) or an aryl group (e.g., the aryl group as illustrated in $R_1$)] nitro and hydrogen; D represents an arylene group such as a phenylene and naphthylene; E represents a group selected from an alkylene group, an arylene group and an aralkylene group; $X^{\ominus}$ represents an anion [e.g. a halide ion (e.g., chloride ion, bromide ion, etc.) a perchlorate ion etc.]; and n is 1 or 2, provided that the compound forms an intra-molecular salt when n is 1.

The cation moiety of the tetrazolium compounds used in the invention will be shown below but they are not intended to limit the moiety capable of being used in the invention. Preferably said anion is selected from surfactant having at least 9 carbon atom being represented by the general formulae [IV], [V], [VI], [VII] or [VIII].

Formula [IV]:

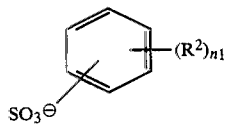

wherein $R^2$ represents an alkyl group including alkyl and substituted alkyl; and $n_1$ is an integer of 1 to 3.

For example 4-isopropylbenzenesulfonate
2,3,5-triethylbenzenesulfonate
4-dodecylbenzenesulfonate
4-(2-fluoro)-hexylbenzenesulfonate Formula [V]:

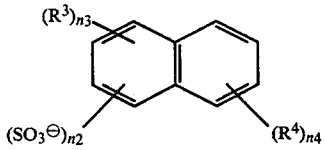

wherein $R^3$ and $R^4$ individually represent hydrogen, an alkyl group including alkyl and substituted alkyl, $n_2$, $n_3$ and $n_4$ are integer of 1 to 3.

For example 1,5-di-isopropyl naphthalene-4-sulfonate
2,6-di-tert-amyl naphthalene-4-sulfonate
1,5-di-isopropyl naphthalene-4,8-di-sulfonate
2,4-di-methyl-6-n-propyl naphthalene-8-sulfonate
1,5-di-(2-chloropentyl)-naphthalene-4-sulfonate Formula [VI]:

$$R^5-\underset{\underset{R^6}{|}}{CH}\leftarrow R^7-O\rightarrow_{n_5}A$$

wherein $R^5$ and $R^6$ individually represent hydrogen, an alkyl group including alkyl and substituted alkyl, $R^7$ represents ethylene group including ethylene and substituted ethylene and propylene group including propylene and substituted propylene, $n_5$ is an integer (preferably 10 to 100), A represents $-SO_3^{\ominus}$ and $-COO^{\ominus}$ For example $$C_2H_5-\underset{\underset{C_3H_7(n)}{|}}{CH}-(CH_2CH_2O)_{10}SO_3^{\ominus}$$

$$CH_3-\underset{\underset{CH_3}{|}}{CH}-(CH_2CH_2O)_{20}SO_3^{\ominus}$$

$$(n)C_{12}H_{25}-\underset{\underset{CH_3}{|}}{CH}-(CH_2CH_2O)_{30}SO_3^{\ominus}$$

$$CH_3\underset{\underset{OH}{|}}{CH}CH_2-\underset{\underset{C_2H_5}{|}}{CH}-(CH_2CH_2O)_{45}SO_3^{\ominus}$$

$$CF_3\underset{\underset{COOH}{|}}{CH}CH_2-\underset{\underset{CH_3}{|}}{CH}-(CH_2CH_2O)_{60}COO^{\ominus}$$

Formula [VII]:

$$R^8-\underset{\underset{R^9-CH_2}{|}}{CH}-SO_3^{\ominus}$$

wherein $R^8$ represents hydrogen; an alkyl group including alkyl and substituted alkyl, and an alkyloxycarbonyl group including alkyloxycarbonyl and substituted alkyloxycarbonyl group; $R^9$ represents an alkyl group including alkyl and substituted alkyl and an alkyloxycarbonyl group including alkyloxycarbonyl and substituted alkyloxycarbonyl.

For example $(n)C_{12}H_{25}SO_3^{\ominus}$

-continued $$\ominus O_3S-\underset{\underset{CH_2-COOCH_2-\underset{\underset{C_2H_5}{|}}{CH}-(CH_2)_3-CH_3}{|}}{CH}-COOCH_2-\underset{\underset{C_2H_5}{|}}{CH}-(CH_2)_3-CH_3$$

$$\ominus O_3S-\underset{\underset{CH_2-COOCH_2-\underset{\underset{CF_3}{|}}{CH}-(CH_2)_3CH_3}{|}}{CH}-COOCH_2-\underset{\underset{CH_3}{|}}{CH}(CH_2)_3CH_3$$

$$O_3S-\underset{\underset{CH_2-COO(CH_2)_7CH_3}{|}}{CH}-COO(CH_2)_7CH_3$$

Formula [VIII]:

$R^{10}-COO^{\ominus}$ wherein $R^{10}$ represents a saturated or an unsaturated alkyl group including alkyl and substituted alkyl.

For example $n-C_{11}H_{23}COO^{\ominus}$ $n-C_{17}H_{35}COO^{\ominus}$ $CH_3(CH_2)_7CH{=}CH(CH_2)_7COO^{\ominus}$ (1) 2,3,5-Triphenyl-2H-tetrazolium
(2) 2,3,5-Tri(p-carboxyethylphenyl)-2H-tetrazolium
(3) 2-(Benzothiazol-2-yl)-3-phenyl-5-(o-chlorophenyl)-2H-tetrazolium
(4) 2,3-Diphenyl-2H-tetrazolium
(5) 2,3-Diphenyl-5-methyl-2H-tetrazolium
(6) 3-(p-Hydroxyphenyl)-5-methyl-2-phenyl-2H-tetrazolium
(7) 2,3-Diphenyl-5-ethyl-2H-tetrazolium
(8) 2,3-Diphenyl-5-n-hexyl-2H-tetrazolium
(9) 5-Cyano-2,3-diphenyl-2H-tetrazolium
(10) 2-(Benzothiazol-2-yl)-5-phenyl-3-(4-tolyl)-2H-tetrazolium
(11) 2-(Benzothiazol-2-yl)-5-(4-chlorophenyl)-3-(4-nitrophenyl)-2H-tetrazolium
(12) 5-Ethoxycarbonyl-2,3-di(3-nitrophenyl)-2H-tetrazolium
(13) 5-Acetyl-2,3-di(p-ethoxyphenyl)-2H-tetrazolium
(14) 2,5-Diphenyl-3-(p-tolyl)-2H-tetrazolium
(15) 2,5-Diphenyl-3-(p-iodophenyl)-2H-tetrazolium
(16) 2,3-Diphenyl-5-(p-diphenyl)-2H-tetrazolium
(17) 5-(p-Bromophenyl)-2-phenyl-3-(2,4,6-trichlorophenyl)-2H-tetrazolium
(18) 3-(p-Hydroxyphenyl)-5-(p-nitrophenyl)-2-phenyl-2H-tetrazolium
(19) 5-(3,4-Dimethoxyphenyl)-3-(2-ethoxyphenyl)-2-(4-methoxyphenyl)-2H-tetrazolium
(20) 5-(4-Cyanophenyl)-2,3-diphenyl-2H-tetrazolium
(21) 3-(p-Acetamidophenyl)-2,5-diphenyl-2H-tetrazolium
(22) 5-Acetyl-2,3-diphenyl-2H-tetrazolium
(23) 5-(Fur-2-yl)-2,3-diphenyl-2H-tetrazolium
(24) 5-(thien-2-yl)-2,3-diphenyl-2H-tetrazolium
(25) 2,3-Diphenyl-5-(pyrid-4-yl)-2H-tetrazolium
(26) 2,3-Diphenyl-5-(quinol-2-yl)-2H-tetrazolium
(27) 2,3-Diphenyl-5-(benzoxazol-2-yl)-2H-tetrazolium
(28) 2,3-Diphenyl-5-nitro-2H-tetrazolium
(29) 2,2',3,3'-Tetraphenyl-5,5'-1,4-butylene-di-(2H-tetrazolium)
(30) 2,2',3,3'-Tetraphenyl-5,5'-p-phenylene-di-(2H-tetrazolium)

(31) 2-(4,5-Dimethylthiazol-2-yl)-3,5-diphenyl-2H-tetrazolium
(32) 3,5-Diphenyl-2-(triazin-2-yl)-2H-tetrazolium
(33) 2-(Benzothiazol-2-yl)-3-(4-methoxyphenyl)-5-phenyl-2H-tetrazolium
(34) 2-p-Iodophenyl-3-nitrophenyl-5-phenyl-2H-tetrazolium Among the diffusible and non-diffusible tetrazolium compounds used in the invention, 2,3,5-triphenyl-2H-tetrazolium group compounds may preferably be used in the invention.

More preferable properties can be attained by using a combination of tetrazolium compounds. For example, the combination of 2,3,5-triphenyl-2H-tetrazolium chloride and 2,5-diphenyl-3-(p-iodophenyl)-2H-tetrazolium, or the combination of the compound obtained from 2,3,5-triphenyl-2H-tetrazolium and diisopropylnaphthalene disulfonic acid with the compound obtained from 2-p-iodophenyl-3-p-nitrophenyl-5-phenyl-2H-tetrazolium and diethylhexylsuccinate sulfonic acid. These combinations have characteristics in which the range of development latitude is broader.

In cases where the tetrazolium compounds used in the invention are used in a non-diffusible form, a non-diffusible compound obtained by reacting a diffusible compound in the above-exemplified compounds with an anion is used.

The non-diffusible tetrazolium compounds according to the invention are thus synthesized by an optional selection of the anionic and cationic moieties. The non-diffusible compounds, e.g. 2,3,5-triphenyl-2H-tetrazolium dioctyl-succinate-sulfonate may be dispersed into a gelatin solution by mixing the respective soluble tetrazolium salt and the gelatin first to disperse them in the gelatin solution and then the anion is admixed thereto, thereby to obtain the gelatin solution dispersed with the non-diffusible, tetrazolium compound as specifically mentioned in working Examples set forth later.

Alternatively, pure synthesized crystals of the non-diffusible tetrazolium compound may be dissolved in a suitable solvent such as dimethylsulfoxide and then dispersed in the gelatin solution.

When the dispersion is not sufficiently homogeneous, good results may be obtained by exposing the emulsion dispersion to an ultrasonic wave or by use of a suitable homogenizer such as Manton-Gaulin homogenizer.

The following are typical examples of the salts of tetrazolium which may be used in this invention but not intended to limit the salts of tetrazolium compound employable in this invention.

(1) 2-(Benzothiazol-2-yl)-3-phenyl-5-dodecyl-2H-tetrazolium bromide
(2) 2,3-Diphenyl-5-(4-t-octyloxyphenyl)-2H-tetrazolium chloride
(3) 2,3,5-Triphenyl-2H-tetrazolium chloride
(4) 2,3,5-Tri(p-carboxyethylphenyl)-2H-tetrazolium chloride
(5) 2-(Benzothiazol-2-yl)-3-phenyl-5-(o-chlorophenyl)-2H-tetrazolium bromide
(6) 2,3-Diphenyl-2H-tetrazolium chloride
(7) 2,3-Diphenyl-5-methyl-2H-tetrazolium chloride
(8) 3-(p-Hydroxyphenyl)-5-methyl-2-phenyl-2H-tetrazolium bromide
(9) 2,3-Diphenyl-5-ethyl-2H-tetrazolium bromide
(10) 2,3-Diphenyl-5-n-hexyl-2H-tetrazolium bromide
(11) 5-Cyano-2,3-diphenyl-2H-tetrazolium bromide
(12) 2-(Benzothiazol-2-yl)-5-phenyl-3-(4-tolyl)-2H-tetrazolium bromide
(13) 2-(Benzothiazol-2-yl)-5-(4-chlorophenyl)-3-(4-nitrophenyl)-2H-tetrazolium chloride
(14) 5-Ethoxycarbonyl-2,3-di(3-nitrophenyl)-2H-tetrazolium chloride
(15) 5-Acetyl-2,3-di(p-ethoxyphenyl)-2H-tetrazolium bromide
(16) 2,5-Diphenyl-3-(p-tolyl)-2H-tetrazolium chloride
(17) 2,5-Diphenyl-3-(p-iodophenyl)-2H-tetrazoloium chloride
(18) 2,3-Diphenyl-5-(p-diphenyl)-2H-tetrazolium chloride
(19) 5-(p-Bromophenyl)-2-phenyl-3-(2,4,6-trichlorophenyl)-2H-tetrazolium chloride
(20) 3-(p-Hydroxyphenyl)-5-(p-nitrophenyl)-2-phenyl-2H-tetrazolium chloride
(21) 5-(3,4-Dimethoxyphenyl)-3-(2-ethoxyphenyl)-2-(4-methoxyphenyl)-2H-tetrazolium chloride
(22) 5-(4-Cyanophenyl)-2,3-diphenyl-2H-tetrazolium chloride
(23) 3-(p-Acetamidophenyl)-2,5-diphenyl-2H-tetrazolium bromide
(24) 5-Acetyl-2,3-diphenyl-2H-tetrazolium bromide
(25) 5-(Fur-2-yl)-2,3-diphenyl-2H-tetrazolium chloride
(26) 5-(Thien-2-yl)-2,3-diphenyl-2H-tetrazolium chloride
(27) 2,3-Diphenyl-5-(pyrid-4-yl)-2H-tetrazolium chloride
(28) 2,3-Diphenyl-5-(quinol-2-yl)-2H-tetrazolium bromide
(29) 2,3-Diphenyl-5-(benzoxazol-2-yl)-2H-tetrazolium bromide
(30) 2,3-Diphenyl-5-nitro-2H-tetrazolium bromide
(31) 2,2′3,3′-Tetraphenyl-5,5′-1,4-butylene-di-(2H-tetrazolium)bromide
(32) 2,2′,3,3′-Tetraphenyl-5,5′-p-phenylene-di-(2H-tetrazolium)bromide
(33) 2-(4,5-Dimethylthiazol-2-yl)-3,5-diphenyl-2H-tetrazolium bromide
(34) 3,5-Diphenyl-2-(triazin-2-yl)-2H-tetrazolium chloride
(35) 2-(Benzothiazol-2-yl)-3-(4-methoxyphenyl)-5-phenyl-2H-tetrazolium bromide
(36) 2-p-Iodophenyl-3-p-nitrophenyl-5-phenyl-2H-tetrazolium chloride
(37) 2-(Benzothiazol-2-yl)-3-phenyl-5-dodecyl-2H-tetrazolium stearate
(38) 2,3-Diphenyl-5-(4-t-octyloxyphenyl)-2H-tetrazolium laurate
(39) 2,3,5-Triphenyl-2H-tetrazolium di-2-ethylhexylsulfosuccinate
(40) 2,3,5-Tri(p-carboxyethylphenyl)-2H-tetrazolium stearate
(41) 2-(Benzothiazol-2-yl)-3-phenyl-5-(o-chlorophenyl)-laurate-2H-tetrazolium p-dodecylbenzenesulfonate
(42) 2,3-Diphenyl-2H-tetrazolium di-2-ethylhexylsulfosuccinate
(43) 2,3-Diphenyl-5-methyl-2H-tetrazolium p-octylbenzenesulfonate
(44) 3-(p-Hydroxyphenyl)-5-methyl-2-phenyl-2H-tetrazolium stearate
(45) 2,3-Diphenyl-5-ethyl-2H-tetrazolium di-3-methylnonylsulfonate
(46) 2,3-Diphenyl-5-n-hexyl-2H-tetrazolium p-octadecylbenzenesulfonate
(47) 5-Cyano-2,3-diphenyl-2H-tetrazolium di-2-ethylhexylsuccinate

(48) 2-(Benzothiazol-2-yl)-5-phenyl-3-(4-tolyl)-2H-tetrazolium p-dodecylbenzenesulfonate
(49) 2-(Benzothiazol-2-yl)-5-(4-chlorophenyl)-3-(4-nitrophenyl)-2H-tetrazolium di-isopropylnaphthalenesulfonate
(50) 5-Ethoxycarbonyl-2,3-di(3-nitrophenyl)-2H-tetrazolium stearate
(51) 5-Acetyl-2,3-di(p-ethoxyphenyl)-2H-tetrazolium laurate
(52) 2,5-Diphenyl-3-(p-tolyl)-2H-tetrazolium stearate
(53) 2,5-Diphenyl-3-(p-iodophenyl)-2H-tetrazolium laurate
(54) 2,3-Diphenyl-5-(p-diphenyl)-2H-tetrazolium di-isopropylnaphthalenesulfonate
(55) 5-(p-Bromophenyl)-2-phenyl-3-(2,4,6-trichlorophenyl)-2H-tetrazolium di-isopropylnaphthalene-disulfonate
(56) 3-(p-Hydroxyphenyl)-5-(p-nitrophenyl)-2-phenyl-2H-tetrazolium p-dodecylbenzoenesulfonate
(57) 5-(3,4-Dimethoxyphenyl)-3-(2-ethoxyphenyl)-2-(4-methoxyphenyl)-2H-tetrazolium di-2-ethylhexylsulfosuccinate
(58) 5-(4-Cyanophenyl)-2,3-diphenyl-2H-tetrazolium laurate
(59) 3-(p-Acetamidophenyl)-2,5-diphenyl-2H-tetrazolium stearate
(60) 5-Acetyl-2,3-diphenyl-2H-tetrazolium p-octadecylbenzenesulfonate
(61) 5-(Fur-2-yl)-2,3-diphenyl-2H-tetrazolium di-2-ethylhexylsulfonate
(62) 5-(Thien-2-yl)-2,3-diphenyl-2H-tetrazolium stearate
(63) 2,3-Diphenyl-5-(pyrid-4-yl)-2H-tetrazolium laurate
(64) 2,3-Diphenyl-5-(quinol-2-yl)-2H-tetrazolium stearate
(65) 2,3-Diphenyl-5-(benzoxazol-2-yl)2H-tetrazolium laurate
(66) 2,3-Diphenyl-5-nitro-2H-tetrazolium di-isopropylnaphthalenesulfonate
(67) 2,2',3,3'-Tetraphenyl-5,5'-1,4-butylene-di-(2H-tetrazolium)di-3-propylnonylsulfonate
(68) 2,2',3,3'-Tetraphenyl-5,5'-p-phenylene-di-(2H-tetrazolium)p-dodecylbenzenesulfonate
(69) 2-(4,5-Dimethylthiazol-2-yl)-3,5-diphenyl-2H-tetrazolium stearate
(70) 3,5-Diphenyl-2-(triazin-2-yl)-2H-tetrazolium laurate
(71) 2-(Benzothiazol-2-yl)-3-(4-methoxyphenyl)-5-phenyl-2H-tetrazolium p-tolylsulfonate
(72) 2-p-iodophenyl-3-p-nitrophenyl-5-phenyl-2H-tetrazolium di-isopropylnaphthalene-di-sulfonate
(73) 2,3,5-triphenyl-2H-tetrazolium di-isopropylnaphthalene-disulfonate Among the non-diffusible tetrazolium compounds employed in the invention, the compound obtained from 2,3,5-triphenyl-2H-tetrazolium and diisopropylnaphthalenedisulfonic acid, the compound obtained from 2,3,5-triphenyl-2H-tetrazolium and diethylhexylsuccinate disulfonic acid and the compound obtained from 2-p-iodophenyl-3-p-nitrophenyl-5-phenyl-2H-tetrazolium and diethylhexylsuccinate disulfonic acid may preferably be used in the invention.

As mentioned above, the tetrazolium compounds of this invention may be used both in diffusible and non-diffusible forms, when the silver halide of this invention is employed. However, the higher contrast image may be obtained by employing the non-diffusible tetrazolium compounds. Accordingly, it is advantageous to employ the non-diffusible tetrazolium compound when an especially superior dot quality is required.

On the other hand, the use of too much high contrast light-sensitive material sometimes brings about insufficient reproduction of the line-image, particularly those of fine letters and lines. In this case, an image with more superior quality may be obtained by the use of the diffusible tetrazolium compounds.

According to a preferred embodiment of the invention, the tetrazolium compound of the invention is incorporated into a silver halide emulsion layer containing the silver halide of this invention.

According to another preferred embodiment of the invention, the compound is incorporated in a hydrophilic colloidal layer adjacent directly or through a intermediate layer to the silver halide emulsion layer.

According to a further preferable embodiment of the invention, the above-mentioned compound is added to the silver halide emulsion layer to be dispersed by oil-protection not to contact directly with silver halide.

The above-mentioned tetrazolium compounds of the invention may preferably be employed in an amount of 0.0001–10 mole, more preferably 0.001–1 mole, per mole of the silver halide contained in the light-sensitive silver halide photographic material of the invention.

As the silver halide employed for the light-sensitive silver halide photographic material of the invention, there can be included silver halide used for the conventional silver halide photographic materials, e.g. silver bromide, silver chlorobromide, silver iodobromide, silver chloroiodobromide or silver chloride and the like. The average grain size of the silver halide in the invention is 0.05–1.5$\mu$, preferably 0.1–0.8$\mu$, and at least 75%, preferably more than 80% of the total grains are within a range of 0.6–1.4, preferably 0.7–1.3 times the average grain size. There may preferably be used silver chlorobromide or chloroiodobromide having the average grain size and the grain size distribution mentioned above and containing at least 50 mole % of silver chloride. The silver halide of the invention having the above-mentioned average grain size and the distribution thereof may be prepared by any known method described, e.g. in U.S. Patents 2,592,250, 3,276,877, 3,317,322, 2,222,264, 3,320,069 and 3,206,313 and in Journal of Photographic Science 12(5), 242–251 (1964). Silver halides prepared by other methods may also be employed in mixture.

According to the most preferred concrete embodiment of the invention, the silver halide of the invention is silver chloroiodobromide or chlorobromide having an average grain size of 0.1–0.8$\mu$, preferably 0.25–0.5$\mu$ and at least 80% of the total grains being within a range of 0.7–1.3 times the average grain size.

The silver halide emulsion of the invention may be sensitized with various kinds of chemical sensitizers. As the sensitizer, there can be mentioned, for example, activated gelatin, sulfur sensitizers (e.g. sodium thiosulfate, allyl thiocarbamide, thiourea or allyl isothiocyanate, etc.), selenium sensitizers (e.g. N,N-dimethylselenourea or selenourea, etc.), reducing sensitizers (e.g. triethylenetetramine or stannic chloride, etc.) and various noble metal sensitizers represented by potassium chloroaurite, potassium auriothiocyanate, potassium chloroaurate, 2-aurosulfobenzothiazole methylchloride, ammonium chloropalladate, potassium chloroplatinate and sodium chloropalladite, etc. The sensitizer may be employed alone, or mixed together. Ammonium thiocyanate may be auxiliarily employed when a gold sensitizer is employed.

Various kinds of sensitizing dyes may be employed for the purpose. As the optical sensitizers employed advantageously in the invention are mentioned, e.g. a cyanine, merocyanine, tri- or tetranuclei merocyanine, tri- or tetranuclei cyanine, styryl, holopolar cyanine, hemicyanine, oxonole, hemioxonole, and the like.

The optical sensitizers preferably contain within the chemical structure thereof a nitrogen-containing heterocyclic nucleus, e.g. a basic group such as thiazoline or thiazole, or rhodanine, thiohydantoin, oxazolidinedione, barbituric acid, thiobarbituric acid or pyrazolone. The nucleus may be substituted with an alkyl, hydroxyalkyl, halogen, phenyl, cyano or alkoxy group or may be fused with a hydrocarbon or heterocyclic ring.

Further, in cases where the above-mentioned optical sensitizer, particularly merocyanine dye is used, not only the optical sensitization may be effected but also the development latitute can be broadened.

The silver halide emulsion of the invention may preferably be stabilized with 5,6-trimethylene-7-hydroxy-s-triazolo(1,5-a)pyrimidine, 5,6-tetramethylene-7-hydroxy-s-triazolo(1,5-a)pyrimidine, 5-methyl-7-hydroxy-s-triazolo(1,5-a)pyrimidine, 7-hydroxy-s-triazolo(1,5-a)pyrimidine, 5-methyl-6-bromo-7-hydroxy-s-triazolo(1,5-a)pyrimidine, esters or salts of gallic acid (e.g. isoamyl gallate, dodecyl gallate, propyl gallate or sodium gallate), mercaptans (e.g. 1-phenyl-5-mercaptotetrazole or 2-mercaptobenzothiazole), benzotriazoles (e.g. 5-bromobenzotriazole or 4-methylbenzotriazole) and benzimidazoles (e.g. 6-nitrobenzimidazole). Such stabilizers are described in, e.g. U.S. Pat. Nos. 2,444,607, 2,716,062, 3,512,982 and 3,342,596, German Patent Publications Nos. 1,189,380, 2,058,626, 2,118,411 and 2,149,789, Japanese Patent Publications Nos. 4,417/1972 and 13,566/1974. Furthermore, the silver halide emulsion of the invention may contain a latent image stabilizer such as a sulfur-containing amino acid, or a gradation-adjusting agent such as a cadmium or rhodium salt, described in, e.g. German Patent Publications Nos. 2,217,153 and 2,217,895.

It has been known in, e.g. British Patent No. 775,197 and U.S. Pat. No. 3,488,709, to employ a rhodium or cadmium salt to increase the contrast of silver halide emulsion. However, problems still remain when the rhodium salt is employed. For example, the use of rhodium salt tends to cause an unevenness of the product due to the minute amount of addition and the narrow allowable range thereof of the salt, and thus makes it difficult to produce stable photographic material. In case of the cadmium salt, it has to be added as little as possible from an ecological viewpoint, for it is washed out by film-processing and comes finally into the environment. The cadmium salts are known to prevent the metabolism and to be harmful to living tissues. Cadmium may be detected not only in air but also in the body of sea animals. As a result of interest in public health and in the maintenance of normal ecological balance in view of the toxicity of rare metals, including cadmium mentioned above, the inventors have reached the invention relating to a novel method to obtain a light-sensitive material with sufficiently high contrast, without such harmful metals. The above-mentioned silver halide and tetrazolium compound of the invention are incorporated into the hydrophilic colloidal layer.

The hydrophilic colloid advantageously employed in the invention is gelatin. As other hydrophilic colloids than gelatin, are mentioned, e.g. colloidal albumin, agar, gum arabic, arginic acid, hydrolyzed cellulose acetate, acrylamide, imidated polyamide, polyvinyl alcohol, hydrolized polyvinyl acetate, water-soluble polymer described in, e.g. British Patent 523,661, German Patent Publications Nos. 2,255,711 and 2,046,682, U.S. Pat. No. 3,341,332, gelatin derivatives such as phenylcarbamyl-, acylated- or phthalated- gelatin described in, e.g. U.S. Pat. Nos. 2,614,928 and 2,525,753, or gelatin graft-polymerized with a monomer having an ethylene group and being capable of polymerization, such as acrylic acid and the ester thereof, styrene, a methacrylic acid and the ester thereof, described in, e.g. U.S. Pat. Nos. 2,548,520 and 2,831,767. Such hydrophilic colloids may also be applied to a layer containing no silver halide, e.g. an antihalation layer, a protective layer or a intermediate layer.

The light-sensitive silver halide material of the invention may be prepared by coating the above-mentioned layer containing the silver halide, and the tetrazoloium compound of the invention on a suitable photographic support. As the representative supports employed in the invention are mentioned, e.g. a baryta paper, a polyethylene-coated paper, a synthetic polypropylene paper, a glass plate, a cellulose acetate or cellulose nitrate film, a polyester film such as a polyethylene terephthalate film, a polyamide film, a polypropylene film, a polycarbonate film, a polystyrene film and the like. The supports are optionally selected depending on the purpose for which the light-sensitive photographic material is used.

As mentioned above, the light-sensitive silver halide photographic material of the invention comprises a silver halide and a tetrazolium compound of the invention.

It is preferable in the light-sensitive material of the invention that a protective layer having a suitable thickness is coated. The protective layer is advantageously a gelatin layer, the thickness of which is preferably 0.1–10$\mu$, more preferably 0.8–2.0$\mu$.

The hitherto known lith type light-sensitive silver halide photographic materials usually have a protective layer. In this invention, however, the protective layer plays an important role different from known ones.

The protective layer is, in general, coated for the purpose to protect the silver halide emulsion layer from accidental mechanical damage during production processes, e.g. cutting, winding or wrapping process, or during photographing and/or processing caused by contact of the light-sensitive material with any other substance.

The protective layer of the invention not only protects the above-mentioned silver halide emulsion layer but also plays an important role for processing stability. That is, while the lith type light-sensitive material has to be able to form a very high contrast line and dot-image, if a tetrazolium compound oxidizing a developing agent contained in the developing solution of the invention is added in the light-sensitive silver halide photographic material to obtain the above-mentioned high contrast silver image, the above-mentioned tetrazolium compound as a oxidizing agent gives a large influence on the development during the progress thereof and consequently, the quality of the line- or dot-image obtained is largely influenced by the difference of e.g. a developing time, a temperature and an amount of the exposure.

It is not necessarily elucidated in the invention why the presence of the protective layer may act effectively on the stability of the image quality and of the developing process. Presumably, the protective layer may have a function to control adequately the infiltration rate of the a developing agent such as Metol, phenidone etc., from the processing solution into the light-sensitive material, or the diffusion rate of the tetrazolium compound within the light-sensitive material or therefrom to the processing solution.

This effect is remarkable when the tetrazolium compound of the invention is employed. The effect is not so remarkable when an oxidizing agent other than the tetrazolium compound, e.g., those described in Japanese Patent Application No. 94295/1975, are employed.

Various kinds of photographic additives may optionally be added to the above-mentioned hydrophilic colloidal layer of the invention, so long as they do not impair the effect of the invention. As the additives, there can be used, e.g. a gelatin plasticizer, a hardening agent, a surface active agent, an image stabilizer, an ultraviolet absorber, an antistaining agent, a pH adjuster, an antioxidant, an antistatic agent, a viscosity-increasing agent, a granularity improving agent, a dye, a mordant, a brightening agent, a development regulator, a matting agent, and the like.

Among the additives mentioned above, the following may particularly and preferably be employed: viscosity-increasing agents and plasticizers, described in U.S. Pat. Nos. 2,960,404 and 3,767,410, Japanese Patent Publications 4939/1968 and 15462/1970, Japanese Patent Provisional Publication No. 63715/1973, German Patent Publication No. 1,904,604, Belgium Pat. Nos. 762,833 and 558,143, e.g., a styrene/sodium maleate copolymer and dextran sulfate, etc.; hardening agents of an aldehyde, epoxy, ethyleneimine, active halogen, vinylsulfone, isocyanate, sulfonic acid ester, carbodiimide, mucochloric acid or acylolyl, etc.; image stabilizers, e.g. 6,6'-butylidene-bis(2-t-butyl-4-methylphenol) and 4,4'-methylene-bis(2,6-di-t-butylphenol), etc.; ultraviolet absorbers, described in, e.g. Japanese Patent Publications 736/1973, 5496/1973, 41572/1973, 30492/1973 and 31255/1973, U.S. Pat. No. 3,253,921, British Patent No. 1,309,349, particularly 2-(2'-hydroxy-5'-t-butylphenyl)benzotriazole, 2-(2'-hydroxy-3',5'-di-t-butylphenyl)benzotriazole, 2-(2'-hydroxy-3'-t-butyl-5'-butylphenyl)-5-chlorobenzotriazole and 2-(2'-hydroxy-3',5'-di-t-butylphenyl)-5-chlorobenzotriazole; surface active agents for coating aids, emulsifiers, infiltration-improving agents for processing solution, defoamers, or agents for controlling various physical properties of the light-sensitive material, described in, e.g. U.S. Pat. Nos. 3,026,202 and 3,514,293, British Pat. Nos. 548,532 and 1,216,389, Japanese Patent Publications 26580/1969, 19722/1968, 17926/1968, 13166/1968 and 20785/1973, French Patent 202,588, Belgium Patent 773,459, Japanese Patent Provisional Publication 101118/1973, including anionic, cationic, nonionic and amphoteric compounds; mordants described in, e.g. U.S. Pat. Nos. 2,113,381 and 2,548,564; antistaining agents described in, e.g. U.S. Pat. Nos. 2,360,210, 2,728,659, 2,732,300 and 3,700,453, particularly 2-methyl-5-hexadecylhydroquinone, 2-methyl-5-sec-octadecylhydroquinone and 2,5-di-t-octylhydroquinone, etc.; antistatic agents described in, e.g. U.S. Pat. Nos. 2,882,157 and 2,972,535, Japanese Patent Publications Nos. 24159/1971, 39312/1971, 43809/1973, 4853/1974, 64/1974 and 8742/1972, Japanese Patent Provisional Publications Nos. 89979/1973, 20785/1973, 43130/1973, 90391/1973 and 33627/1972; matting agents described in, e.g. U.S. Pat. Nos. 2,992,101 and 2,956,884, British Pat. No. 1,221,980, French Patent No. 1,395,544, Japanese Patent Publication No. 43125/1973, particularly silica gel having a grain size of 0.5–20μ and polymethylmethacrylate having a grain size of 0.5–20μ; developing promotors, e.g. benzyl alcohol and a polyoxyethylene series compound which may be added in the processing bath.

In accordance with the invention, there is obtained a high contrast silver image. The invention is therefore applicable to various fields wherein a high contrast black-and-white recording is required. The light-sensitive material of the invention is, for example, applied preferably to a printing- or micro- sensitive material. The process of the invention for forming a lith type photographic image has superior characteristics which no conventional processes have yet reached.

Although the reasons why a silver image with high contrast can be obtained by the method of the invention have not necessarily be elucidated, it may be considered that the silver image with such high contrast can be obtained due to the fact that the developing agent permeating from the developing solution is locally oxidized by the tetrazolium compound and active chemical species are accumulated in a high concentration near the developed part. It may be presumed that the rate of the active chemical species inactivated by the simultaneous reaction with the sulfite ions existing in large amounts in the developing solution is low.

It is firstly because the supply of active chemical species is far more than the consumption of the same and secondly because it is considered that, when an inhibitor in a developing solution described in the specification of British Patent No. 1,376,600, e.g., 5-nitroindazole, etc., is used, the coupling of sulfite ions and the active chemical species is prevented. Accordingly, it is presumed that, according to the invention, the active chemical species produced may develop the silver halide with high contrast by a mechanism extremely similar to that of the usual infectious development.

In the developing solution of the invention, however, the concentration of sulfite ions need not be lowered at all as in the case of conventional infectious developing solutions. It may be added to the developing solution in large amounts per 1 liter (e.g., 0.25–1 mole, preferably 0.5–0.7 mole) so as to decrease remarkably the oxidation by air or to prevent substantially the oxidation by air. According to the method of the invention, the largest defect in the conventional infectious developing solution has been overcome.

The developing solution of the invention contains substantially no hydroquinone developing agent. More concretely, the developing agent of the invention include each of the organic or inorganic developing agents and developing aids (auxiliaries) described in E. K. Mees and T. H. James, "The Theory of the Photographic process", 3rd edition, P. 278–381 (1966), and the combination thereof.

The developer used in this invention is a developer comprising a developing agent other than a hydroquinone developing agent.

As to the developing agents used in this invention, any compound (except hydroquinone developing agents) capable of reducing silver halides can be generally used and typical examples of the compound are following organic and inorganic compounds:

Inorganic developing agent

Fe(II), Co(II), Ti(III) and V(II) ions and complexes thereof, for example, EDTA-Fe(II) salt, $(C_2O_4)_2Fe(II)$ salt, $(C_6H_5O_7)_3Fe(II)$ salt and bis(1-hydroxy-3-methylcyclopentadienyl)Fe(II) salt, and copper complexes such as $Cu(NH_3)_2^-$, dithionite such as $Na_2S_2O_4$, and organic substitution products of inorganic developing agents such as hydroxylaminehydrazine, phenylhydrazine, hydrazobenzene and phenylhydroxylamine.

Organic developing agent

The compounds represented by the following formula (A) are preferably used:

$$R_1'—Z—R_2' \quad (A)$$

wherein Z is an arylene group including arylene and substituted arylene such as phenylene, naphthylene and phenylene or naphthylene substituted with the group consisting of hydroxyl, alkyl (such as methyl, ethyl, propyl) carboxyl, halogen (such as chlorine bromine), acetamido, alkoxy (such as methoxy ethoxy), amino, hydroxybenzoyl, phenyl; $R_1'$ and $R_2'$ are individually hydroxyl or an

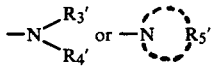

in which $R_3'$ and $R_4'$ each represent hydrogen, hydroxyl, an alkyl group including alkyl and substituted alkyl such as methyl, ethyl, propyl, or alkyl substituted with the group consisting of alkoxy, aryloxy, hydroxyl, alkylacylamino, arylacylamino, alkylsulphonamido, arylsulphonamido, alkylcarbamoyl, arylcarbamoyl and carboxyl; $R_5'$ represents a non-metallic atomic group for forming 5- or 6-membered heterocyclic ring, the atomic group being such as morpholino, tetrahydrofurfuryl, piperidino.

In this Formula (A), both of $R_1'$ and $R_2'$ cannot simultaneously be hydroxyl when $R_1'$ and $R_2'$ are attached to said arylene group of Z in para-position relationship.

Catechol,
4-Chlorocatechol,
3-Phenylcatechol,
4-Phenylcatechol,
3-Methoxycatechol,
4-Acetylpyrogallol,
4-(2'-Hydroxybenzoyl)pyrogallol,
Sodium ascorbate,
4-Aminophenol,
2-Amino-6-phenylphenol,
2-Amino-4-chloro-6-phenylphenol,
4-Amino-2-phenylphenol,
4-Methylaminophenol ½ sulfate salt,
3,4-Diaminophenol,
3-Methyl-4,6-diaminophenol,
2,4-Diaminoresorcinol,
2,4,6-Triaminophenol,
N-Methyl-p-aminophenol,
N-β-Hydroxyethyl-p-aminophenol,
p-Hydroxyphenylaminoacetic acid (glycine for photographic use),
1,2-Aminonaphthol,
4-Amino-2-methyl-N,N-diethylaniline,
2,4-Diamino-N,N-diethylaniline,
N-(4-amino-3-methylphenyl)morpholine,
p-Phenylenediamine,
4-Amino-N,N-dimethyl-3-hydroxyaniline,
N,N,N',N'-Tetramethylparaphenylenediamine,
4-Amino-N-ethyl-N-(β-hydroxyethyl)-aniline,
4-Amino-3-methyl-N-ethyl-N-(β-hydroxyethyl)-aniline
4-Amino-N-ethyl-(β-methoxyethyl)-3-methylaniline,
4-Amino-3-methyl-N-ethyl-N-(β-methylsulfonamidoethyl)-aniline,
4-Amino-N-butyl-N-γ-sulfobutylaniline,
1-(4-Aminophenyl)-pyrrolidone,
6-Amino-1-ethyl-1,2,3,4-tetrahydroquinoline, and
9-Aminojulolidine Heterocyclic ring type developing agents 1-Phenyl-3-pyrazolidone,
1-Phenyl-4-amino-5-pyrazolidone,
1-(p-Aminophenyl)-3-amino-2-pyrazoline,
1-Phenyl-3-methyl-4-amino-5-pyrazolone,
5-Aminouracil and
5-Amino-2,4,6-trihydroxypyrimidine.

More preferable are: use of Metol, alone the combination of phenidone and Metol, the combination of p-aminophenol and catechol and the combination of phenidone and p-aminophenol. But further various combinations thereof can afford good photographic images. The developing solution of the invention may desirably have a pH value of 8.5–12.0, preferably 9.5–11.0.

Characteristics inherent to the invention which can not be found in the process with a developing solution containing a hydroquinone developing agent, can be derived by using the above-mentioned developing agents and combinations of the same. The characteristics are as follows.

(1) A good photographic property can be obtained in a short development time.

(2) The toe part of the characteristic curve is reduced sharply and photographing properties of dot and line are excellent.

(3) γ-value in compliance with the purpose can be obtained by optional selection of the developing agents.

(4) Reducing power property is excellent since the developed silvers are fine grains.

(5) Since the amount of absorbent substances are small against developed silver, there is no remaining color when a reducing solution of iron chelate or celium chelate using no hypoferrocyan is employed and reduction can smoothly be effected.

(6) The developability of shadow-dot part is the same as that of highlight-dot part (this is described hereinafter).

(7) Reliability of γ upon development time is little.

Although there were many problems regarding the above-mentioned items when hydroquinones are used as a developing agent, a high contrast photographic image with a good quality has can now be obtained by the skillful combination of the light-sensitive silver halide photographic material of the invention and the developing agent of the invention.

It has hitherto been known that a ultra high contrast black-and-white developing solution usually contains hydroquinones. Particularly, hydroquinones have been indispensable as the developing agent in order to cause infectious development (lith development). According to the invention, it may be said that a stable ultra high contrast development system which would replace conventional infectious development systems has been completed.

The effect of the invention is not impaired even by using such a preservative as, for example, sodium sulfite, potassium sulfite, ammonium sulfite, etc., in the developing solution employed for the invention, which fact may be mentioned as one of the characteristics of the invention. The sulfite may desirably be contained in an amount of not less than 10 g/l preferably 30 to 80 g/l. It is optional to adjust the pH value and buffer the medium with a caustic alkali, an alkali carbonate, an amine, etc., as used in the general black-and-white developing solution, and to add an inorganic development inhibitor such as potassium bromide etc., and an organic development inhibitor such as benztriazole etc.

In the invention, "to treat with a developing solution containing no hydroquinone developing agent" means "to develop, after image-wise exposure of the light-sensitive silver halide photographic material of the invention, in a developing solution which fulfill the conditions mentioned above", and various embodiments may be included. For instance, development temperature may preferably be below 50° C., especially around 30° C. Development time is generally within 10 minutes. Development time within 5 minutes sometimes bring about good results. It is optional to adopt a treatment step after development, e.g., water washing, stopping, stabilization and fixing, and to adopt further, as occasion demands, such a step as pre-hardening, neutralization, etc., and these steps may be omitted according to circumstances.

Further, these treatments may be carried out by so-called development-by-hand such as dish development, frame development, etc., or by machine development such as roller development, hunger development, etc. According to a preferred embodiment of the invention, the processing solution in dish development was stable for a period of time 20 times longer than a conventional lith developing solution. In cases where the hitherto known special developing solution (a developing solution containing extremely small amount of sulfite, namely, a conventional lith type developing solution) was used to improve the dot quality of the lith type light-sensitive material, it became unusable only in several hours. On the contrary to that, the processing solution according to a preferred embodiment of the invention could stably be used after not less than one month past, the dot quality was the same as that obtained by treatment with a new solution. Moreover, even if there are added additives such as a hardening agent, a toe-part-reducer, etc. which have frequently been used in a conventional high contrast developing solution, the photographic properties are not effected.

As may be understood from the above description, the invention relates to a novel light-sensitive silver halide photographic material which comprises the combination of a tetrazolium compound and a silver halide of the invention having narrow grain size distribution and which can afford an excellent dot- or line-image without using any infectious developing solutions by treating said light-sensitive material with a developing solution containing no hydroquinone developing agent, and to a method of processing the same.

According to the invention, an excellent silver image with high contrast can be obtained even when a diffusible tetrazolium compound is used, and a non-diffusible tetrazolium compound may possibly afford, by the method described in the specification of Japanese Patent Application 94295/1975, more excellent dot-image.

While the tetrazolium compound of the invention may preferably be incorporated in a hydrophilic colloidal layer including a silver halide emulsion layer, the invention is not restricted to this. That is, for example, the tetrazolium compound of the invention may be incorporated in the light-sensitive silver halide photographic material of the invention by dissolving it in a suitable solvent and coating, by an over-coat method, etc., directly on the outermost part of the photographic material or the outermost part of photographic material under preparation.

The invention will be explained more concretely by the following Examples, which by no means restrict the scope of the invention, and various modifications can be effected.

COMPARISON 1

A silver chloroiodobromide emulsion containing 30 mole % of silver bromide and 0.2 mole % of silver iodide, having an average grain size of 0.3μ and showing an effective sensitivity within a grain size distribution ranging from 0.15 to 0.40μ was subjected to chemical ripening by using a gold sensitizer and a sulfur sensitizer. To the emulsion were added 0.45 g of 4-hydroxy-6-methyl-1,3,3a,7-tetrazaindene, 0.08 g of spirobis(3,3-dimethyl-5,6-dihydroxyindane) and 2.5 g of saponin per 1 mole of silver halide. Next, the emulsion was coated on a polyethylene terephthalate support so as to contain 55 mg of silver/100 $cm^2$ and 19 mg of gelatin/100 $cm^2$ and further 14 mg of gelatin/100 $cm^2$ was coated as a protective layer over the silver halide emulsion layer to prepare a sample. Next, this sample was wedge-exposed through a contact screen with a pulsed xenon lamp and processed by the following treatment at 30° C.

| | | |
|---|---|---|
| Development | 1.5 | minutes |
| Fixing | 1 | minute |
| Water washing | 1 | " |
| Drying | 50 | seconds |

Developing solution of the following composition was employed.

| | |
|---|---|
| Metol | 5 g |
| Anhydrous sodium sulfite | 60 g |
| Sodium carbonate | 54 g |
| Potassium bromide | 2.5 g |
| 5-Nitrobenzimidazole | 0.5 g |
| 1-Phenyl-5-mercaptotetrazole | 0.2 g |
| Water | to make 1 liter (ph = 10.20) |

COMPARISON 2

A sample was prepared and processed in the same manner as in COMPARISON 1 except that 4 g of potassium dichromate per 1 mole of silver was added to the emulsion prior to the coating.

COMPARISON 3

A sample was prepared and processed in the same manner as in COMPARISON 1 except that 4 g of potassium persulfate per 1 mole of silver was added to the emulsion in place of the potassium dichromate used in COMPARISON 2.

EXAMPLE 1

A sample was prepared and processed in the same manner as in COMPARISON 1 except that 1.8 g of 2,3,5-triphenyltetrazolium chloride per 1 mole of silver was added to the emulsion in place of the potassium dichromate used in COMPARISON 2.

EXAMPLE 2

A sample was prepared and processed in the same manner as in COMPARISON 1 except that 4.0 g of 3-(p-hydroxyphenyl)-5-methyl-2-phenyl-2H-tetrazolium chloride per 1 mole of silver was added to the emulsion in place of the potassium dichromate used in COMPARISON 2.

EXAMPLE 3

A sample was prepared and processed in the same manner as in COMPARISON 1 except that 3.0 g of 2,3-diphenyl-5-ethyl-2H-tetrazolium chloride per 1 mole of silver was added to the emulsion in place of the potassium dichromate used in COMPARISON 2.

EXAMPLE 4

A sample was prepared and processed in the same manner as in COMPARISON 1 except that 2.2 g of a non-diffusible tetrazolium compound synthesized from 2,3-diphenyl-5-nitro-2H-tetrazolium chloride and sodium diisopropylnaphthalenesulfonate per 1 mole of silver was added to the emulsion in place of the potassium dichromate used in COMPARISON 2.

EXAMPLE 5

A sample was prepared and processed in the same manner as in Example 1 except that a developing solution of the following composition was used.

| | |
|---|---|
| Phenidone | 0.3 g |
| Ascorbic acid | 12 g |
| Anhydrous sodium sulfite | 50 g |
| Sodium carbonate | 54 g |
| Potassium bromide | 2.5 g |
| 5-Nitrobenzimidazole | 450 mg |
| Water | to make 1 liter (pH= 10.20) |

EXAMPLE 6

A sample was prepared in the same manner as in Example 4 and processed with the developing solution shown in Example 5.

EXAMPLE 7

A sample was prepared and processed in the same manner as in Example 1 except that a developing solution having the following composition was used.

| | |
|---|---|
| p-Aminophenol | 5 g |
| Ascorbic acid | 12 g |
| Anhydrous sodium sulfite | 50 g |
| Sodium carbonate | 54 g |
| Potassium bromide | 2.5 g |
| 6-Nitroindazole | 100 mg |
| Water | to make 1 liter (pH = 10.20) |

EXAMPLE 8

A sample was prepared and processed in the same manner as in Example 1 except that a developing solution having the following composition was used.

| | |
|---|---|
| 4-Amino-N-ethyl-N-ethoxyaniline | 2 g |
| Metol | 4 g |
| Anhydrous sodium sulfite | 50 g |
| Sodium carbonate | 54 g |
| Potassium bromide | 5 g |
| 5-Methylbenzimidazole | 100 mg |
| Water | to make 1 liter (pH = 10.20) |

EXAMPLE 9

A sample was prepared and processed in the same manner as in Example 1 except that a developing solution having the following composition was used.

| | |
|---|---|
| Phenidone | 0.3 g |
| Metol | 3.5 g |
| Anhydrous sodium sulfite | 50 g |
| Sodium carbonate | 30 g |
| Triethanolamine | 30 g |
| Potassium bromide | 2.5 g |
| 5-Nitroindazole | 80 mg |
| Water | to make 1 liter (pH = 10.20) |

EXAMPLE 10

A sample was prepared in the same manner as in Example 4 and processed with the same developing solution as in Example 9.

Each samples processed were measured according to JIS method with respect to $\gamma$ and fog, and their dot qualities were measured with the eye. The results are shown in Table 1.

Table 1

| Sample | Photographic property $\gamma$ | Fog | Dot quality* |
|---|---|---|---|
| COMPARISON 1 | 2.5 | 0.06 | 1 |
| COMPARISON 2 | 4.0 | 0.08 | 2 |
| COMPARISON 3 | 3.2 | 0.10 | 1 |
| Example 1 | 8 | 0.04 | 3.5 |
| Example 2 | 6 | 0.05 | 3.0 |
| Example 3 | 8 | 0.04 | 3.0 |
| Example 4 | 13 | 0.04 | 4.5 |
| Example 5 | 8 | 0.04 | 3.5 |
| Example 6 | 16 | 0.04 | 5.0 |
| Example 7 | 8 | 0.05 | 3.0 |
| Example 8 | 6 | 0.04 | 3.5 |
| Example 9 | 10 | 0.04 | 4.0 |
| Example 10 | 18 | 0.04 | 5.0 |

*"Dot quality" here in the examples means an evaluated value of a microscopic quality of an image which was obtained through a contact screen. Dot images are composed of the part called generally "shadow dot part" and the part called "highlight dot part". In the intermediate part, dots of various sizes are in line in an orderly way. "Dot quality" as shown in Table 1 means an evaluated value of the dot in the part called "50% dot" in which a half of a definite area is clear and the rest of it is a developed density, and the dot quality is expressed in progressive scale. That is, "5" means excellence and "1" extreme badness. The dot quality below "3" can not practically be employable in general.

As is clear from Table 1, the samples and the processing method of the invention each increase the contrast with extreme effectiveness, and the fog is negligible. Thus, the dot quality are excellent for the use of camera-halftone and camera-line.

Although the samples using diffusible tetrazolium salts (Examples 1, 2 and 3) among the above-mentioned samples of this invention show somewhat lower γ values and dot qualities as compared with the sample using a non-diffusible tetrazolium salt (Example 4), the former is superior for the line image to the latter. The most difficult point on the reproduction technique for line images is to obtain the characters of Gothic type and Ming type with excellent qualities by using the same light-sensitive material. It is clear that the light-sensitive silver halide photographic material of the invention can readily solve the problem.

COMPARISON 4

A silver iodobromide emulsion containing 98.5 mole % of silver bromide and 1.5 mole % of silver iodide, having an average grain size of 0.25μ and showing an effective sensitivity within a grain distribution ranging from 0.23 to 0.28μ was subjected to chemical sensitization with a sulfur sensitizer and a gold sensitizer. To the emulsion were added 0.2 g of polyethylene glycol (Molecular weight: 1,420) oleate and 0.3 g of 4-hydroxy-6-methyl-1,3,3a,7-tetrazaindene per 1 mole of silver. Next, the emulsion was coated on a polyethylene terephthalate support so as to contain 45 mg of silver/100 $cm^2$ and 22 mg of gelatin/100 $cm^2$. Further, 14 mg/100 $cm^2$ of gelatin was coated as a protective layer over the silver halide emulsion layer to prepare a sample. Next, the sample was wedge-exposed through a contact screen with a tungsten lamp and processed by the following treatment at 30° C.

| | |
|---|---|
| Development | 1 minute and 45 seconds |
| Fixing | 1 minute and 20 seconds |
| Water washing | 1 minute |
| Drying | 1 minute (at 47° C.) |

A developing solution having the following composition was employed.

| | |
|---|---|
| Phenidone | 0.3 g |
| Metol | 6 g |
| Anhydrous sodium sulfite | 60 g |
| Sodium carbonate | 50 g |
| Potassium bromide | 2.5 g |
| 5-Nitroindazole | 100 mg |
| 5-Nitrobenztriazole | 20 mg |
| Water | to make 1 liter (pH=10.20) |

COMPARISON 5

A sample was prepared and processed in the same manner as in COMPARISON 4 except that 3 g of hexaamminecobalt (III) chloride per 1 mole of silver was added to the emulsion prior to the coating.

COMPARISON 6

A sample was prepared and processed in the same manner as in COMPARISON 5 except that 3 g of chloramine T (tosylchloramide sodium) per 1 mole of silver was added to the emulsion in place of the hexaamminecobalt (III) chloride used in COMPARISON 5.

COMPARISON 7

A sample was prepared and processed in the same manner as in COMPARISON 5 except that 3 g of 1,1'-dimethyl-4,4'-bipyridium (viologen) per 1 mole of silver was added to the emulsion in place of the hexaamminecobalt (III) chloride used in COMPARISON 5.

EXAMPLE 11

A sample was prepared and processed in the same manner as in COMPARISON 5 except that 4 g of 2,5-diphenyl-3-α-naphthyltetrazolium chloride per 1 mole of silver was added to the emulsion in place of the hexaamminecobalt (III) chloride used in COMPARISON 5.

EXAMPLE 12

A sample was prepared and processed in the same manner as in COMPARISON 5 except that 5 g of 3,3'-(3,3'-dimethoxy-4,4'-diphenylene)-bis-2,5-diphenylenetetrazolium chloride per 1 mole of silver was added to the emulsion in place of the hexaamminecobalt (III) chloride used in COMPARISON 5.

EXAMPLE 13

A sample was prepared and processed in the same manner as in COMPARISON 5 except that 6 g of ion pairs synthesized in gelatin by using equimolar amounts of 2,5-diphenyl-3-α-naphthyltetrazolium chloride of Example 11 and diisopropylnaphthalenesulfonic acid was added to the emulsion.

With respect to each samples processed, γ and fog are measured according to JIS method and the dot quality is measured with the eye. The results are shown in Table 2.

Table 2

| Sample | Photographic properties γ | Fog | Dot quality |
|---|---|---|---|
| COMPARISON 4 | 2.8 | 0.17 | 1 |
| COMPARISON 5 | 3.5 | 0.09 | 1 |
| COMPARISON 6 | 3.3 | 0.11 | 1 |
| COMPARISON 7 | 3.5 | 0.08 | 2 |
| Example 11 | 8 | 0.05 | 3.5 |
| Example 12 | 7 | 0.05 | 3.0 |
| Example 13 | 13 | 0.04 | 4.0 |

As is clear from Table 2, it may be understood that tetrazolium salts among substantially diffusible oxidants give high contrast even when the processing is conducted with a developing solution containing no hydroquinone, and further form dot images which can be used practically. In cases where the tetrazolium compound is substantially non-diffusible, it affords higher contrast and thus excellent dot images can be obtained.

COMPARISON 8

A gelatin emulsion which comprises silver chlorobromide containing 75 mol % of silver chloride and 25 mole % of silver bromide, having an average grain size of 0.23μ and showing an effective sensitivity within a grain distribution ranging from 1.0 to 3.5μ was subjected to chemical ripening by using a gold sensitizer and a sulfur sensitizer. To the emulsion was added 0.62 g of 4-hydroxy-6-methyl-1,3,3a,7-tetrazaindene, 2.5 g of saponin and 1.7 g of ion pairs synthesized from 2,3,5-triphenyl-2H-tetrazolium chloride and diisopropylnaphthalenesulfonic acid per 1 mole of silver to the emulsion. Next, the thus obtained emulsion was coated on a triacetate support so as to contain 45 mg of silver/100 $cm^2$ and 19 mg of gelatin/100 $cm^2$ to prepare a sample. Then the sample was wedge-exposed through a contact screen with a pulsed xenon lamp and processed by the following treatment.

| | |
|---|---|
| Development | The following step development was conducted at a processing temperature of 30° C. (30 sec., 1 min., 1.5 min., 2 min., 3 min., 4 min., 5 min., 10 min., 20 min., 60 min.) |
| Fixing | 2 minutes |
| Water washing | 2 minutes |
| Drying | 1 minute and 15 seconds (at 52° C.) |

A developing solution having the following composition was used.

| | |
|---|---|
| Hydroquinone | 15 g |
| Formaldehyde sodium hydrogensulfite | 50 g |
| Boric acid | 8 g |
| Anhydrous sodium sulfite | 2 g |
| Sodium carbonate monohydrate | 85 g |
| Potassium bromide | 2.5 g |
| Water | to make 1 liter (pH = 9.90) |

EXAMPLE 14

A sample was prepared and processed in the same manner as in COMPARISON 8 except that the developing solution having the following composition was used.

| | |
|---|---|
| Phenidone | 0.4 g |
| Metol | 3 g |
| Anhydrous sodium sulfite | 60 g |
| Potassium carbonate | 60 g |
| Potassium bromide | 2.5 g |
| 5-Nitrobenztriazole | 500 mg |
| Water | to make 1 liter (pH = 10.20) |

EXAMPLE 15

A sample was prepared and processed in the same manner as in COMPARISON 8 except that the developing solution having the following composition was used.

| | |
|---|---|
| Metol | 5 g |
| Anhydrous sodium sulfite | 60 g |
| Potassium carbonate | 30 g |
| Diethanolamine | 30 g |
| Potassium bromide | 2.5 g |
| 5-Nitrobenzimidazole | 500 mg |
| Water | to make 1 liter (pH = 10.20) |

EXAMPLE 16

A sample was prepared and processed in the same manner as in COMPARISON 8 except that the developing solution having the following composition was used.

| | |
|---|---|
| Catecol | 7 g |
| Anhydrous sodium sulfite | 60 g |
| Potassium carbonate | 30 g |
| Diethanolamine | 30 g |
| Potassium bromide | 2.5 g |
| 5-Methylbenzimidazole | 500 mg |
| Water | to make 1 liter (pH = 10.20) |

EXAMPLE 17

A sample was prepared and processed in the same manner as in COMPARISON 8 except that the developing solution having the following composition was used.

| | |
|---|---|
| p-Phenylenediamine | 8 g |
| Anhydrous sodium sulfite | 60 g |
| Potassium carbonate | 30 g |
| Diethanolamine | 30 g |
| Potassium bromide | 2.5 g |
| 5-Nitroindazole | 120 mg |
| Water | to make 1 liter (pH = 10.20) |

EXAMPLE 18

A sample was prepared and processed in the same manner as in COMPARISON 8 except that the developing solution having the following composition was used.

| | |
|---|---|
| p-Aminophenol | 7 g |
| Anhydrous sodium sulfite | 60 g |
| Potassium carbonate | 30 g |
| Diethanolamine | 30 g |
| Potassium bromide | 2.5 g |
| 6-Nitroindazole | 180 mg |
| Water | to make 1 liter (pH = 10.20) |

With respect to each samples of from COMPARISON 8 to Example 18, photographic properties were measured. The results are shown in Table 3.

Table 3

| Sample | Photographic properties γ | Fog | Dot quality | Time for maximum dot quality (minute) |
|---|---|---|---|---|
| COMPARISON 8 | 5 | 0.15 | 2.5 | 60 |
| Example 14 | 18 | 0.04 | 4.5 | 1.5 |
| Example 15 | 16 | 0.04 | 4.5 | 2 |
| Example 16 | 10 | 0.06 | 3.5 | 4 |
| Example 17 | 10 | 0.08 | 3.0 | 5 |
| Example 18 | 16 | 0.04 | 3.5 | 5 |

As is clear from Table 3, it may be understood that high contrast and excellent dot quality can be attained in a short time by processing the light-sensitive silver halide photographic material of the invention with the developing solution of the invention.

What is claimed is:

1. A method of processing a light-sensitive silver halide black and white photographic material to obtain a high contrast black and white silver image, said material comprising a support, a silver halide emulsion layer containing silver halide grains having an average grain size between 0.25 and 0.5μ, at least 80% of said silver halide grains being of a grain size which falls within the range of 0.7 times said average grain size to 1.3 times said average grain size, said silver halide comprising (i) silver chlorobromide or silver chloroiodobromide, and (ii) at least 50 mol % silver chloride, and a tetrazolium compound selected from the group consisting of the compounds having the following general formulas I, II or III:

I

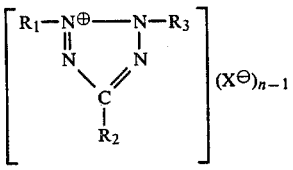

II

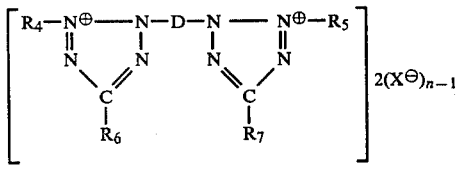

III

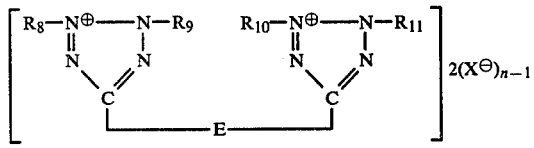

wherein $R_1$, $R_3$, $R_4$, $R_5$, $R_8$, $R_9$, $R_{10}$ and $R_{11}$ each represent an alkyl, alkenyl, aryl or heterocyclic group; $R_2$, $R_6$ and $R_7$ each represent allyl, phenyl, naphthyl, heterocyclic, alkyl or amino group, carboxyl or the salt thereof, an alkoxycarbonyl group, mercapto, nitro or hydrogen; D represents an arylene group; E represents an alkylene, arylene or aralkylene group; $X^{\ominus}$ is an anion; and n is 1 or 2, provided that the compound forms an intramolecular salt when n is 1, comprising exposing said photographic material to an image and to light, and then developing said exposed photographic material in a developing solution which does not contain hydroquinone selected from the group consisting of Metol, phenidone and Metol, p-aminophenol and catechol, and phenidone and p-aminophenol, to form said high contrast black and white silver image.

2. A method according to claim 1 wherein the tetrazolium compound is present in the silver halide emulsion layer.

3. A method according to claim 1 wherein the photographic material further comprises a hydrophilic colloidal layer adjacent to the silver halide emulsion layer, the compound being present in the hydrophilic colloidal layer.

4. A method according to claim 1 wherein the cation moiety of the tetrazolium compound is selected from the group consisting of the following:

(1) 2,3,5-Triphenyl-2H-tetrazolium
(2) 2,3,5-Tri(p-carboxyethylphenyl)-2H-tetrazolium
(3) 2-(Benzothiazol-2-yl)-3-phenyl-5-(o-chlorophenyl)-2H-tetrazolium
(4) 2,3-Diphenyl-2H-tetrazolium
(5) 2,3-Diphenyl-5-methyl-2H-tetrazolium
(6) 3-(p-Hydroxyphenyl)-5-methyl-2-phenyl-2H-tetrazolium
(7) 2,3-Diphenyl-5-ethyl-2H-tetrazolium
(8) 2,3-Diphenyl-5-n-hexyl-2H-tetrazolium
(9) 5-Cyano-2,3-diphenyl-2H-tetrazolium
(10) 2-(Benzothiazol-2-yl)-5-phenyl-3-(4-tolyl)-2H-tetrazolium
(11) 2-(Benzothiazol-2-yl)-5-(4-chlorophenyl)-3-(4-nitrophenyl)-2H-tetrazolium
(12) 5-Ethoxycarbonyl-2,3-di(3-nitrophenyl)-2H-tetrazolium
(13) 5-Acetyl-2,3-di-(p-ethoxyphenyl)-2H-tetrazolium
(14) 2,5-Diphenyl-3-(p-tolyl)-2H-tetrazolium
(15) 2,5-Diphenyl-3-(p-idophenyl)-2H-tetrazolium
(16) 2,3-Diphenyl-5-(p-diphenyl)-2H-tetrazolium
(17) 5-(p-Bromophenyl)-2-phenyl-3-(2,4,6-trichlorophenyl)-2H-tetrazolium
(18) 3-(p-Hydroxyphenyl)-5-(p-nitrophenyl)-2-phenyl-2H-tetrazolium
(19) 5-(3,4-Dimethoxyphenyl)-3-(2-ethoxyphenyl)-2-(4-methoxyphenyl)-2H-tetrazolium
(20) 5-(4-Cyanophenyl)-2,3-diphenyl-2H-tetrazolium
(21) 3-(p-Acetamidophenyl)-2,5-diphenyl-2H-tetrazolium
(22) 5-Acetyl-2,3-diphenyl-2H-tetrazolium
(23) 5-(Fur-2-yl)-2,3-diphenyl-2H-tetrazolium
(24) 5-(Thien-2-yl)-2,3-diphenyl-2H-tetrazolium
(25) 2,3-Diphenyl-5-(pyrid-4-yl)-2H-tetrazolium
(26) 2,3-Diphenyl-5-(quinol-2-yl)-2H-tetrazolium
(27) 2,3-Diphenyl-5-(benzoxazol-2-yl)-2H-tetrazolium
(28) 2,3-Diphenyl-5-nitro-2H-tetrazolium
(29) 2,2',3,3'-Tetraphenyl-5,5'-1,4-butylene-di-(2H-tetrazolium)
(30) 2,2',3,3'-Tetraphenyl-5,5'-p-phenylene-di-(2H-tetrazolium)
(31) 2-(4,5-Dimethylthiazol-2-yl)-3,5-diphenyl-2H-tetrazolium
(32) 3,5-Diphenyl-2-(triazin-2-yl)-2H-tetrazolium
(33) 2-p-Iodophenyl-3-nitrophenyl-5-phenyl-2H-tetrazolium.

5. A method according to claim 1 wherein the light-sensitive silver halide photographic material further comprises a protective layer having a thickness of 0.1 to 10μ.

6. A method according to claim 1 wherein the tetrazolium compound is a compound obtained from 2,3,5-triphenyl-2H-tetrazolium and diisopropylnaphthalenedisulfonic acid.

7. A light-sensitive silver halide photographic material according to claim 1 wherein the tetrazolium compound is a compound obtained from 2,3,5-triphenyl-2H-tetrazolium and diethylhexylsuccinatesulfonic acid.

8. A method of processing a light-sensitive silver halide photographic material according to claim 1 wherein the developing solution contains a sulfite in an amount of not less than 10 g per liter.

9. A method according to claim 1 wherein the developing solution has a pH value of 8.5 to 12.

* * * * *